US012186632B2

(12) United States Patent
Williams

(10) Patent No.: US 12,186,632 B2
(45) Date of Patent: Jan. 7, 2025

(54) DYNAMIC VISCOUS FLOW EFFICIENT SWIM CAP

(71) Applicant: Bruce Preston Williams, Grosse Pointe Park, MI (US)

(72) Inventor: Bruce Preston Williams, Grosse Pointe Park, MI (US)

( * ) Notice: Subject to any disclaimer, the term of this patent is extended or adjusted under 35 U.S.C. 154(b) by 0 days.

(21) Appl. No.: 17/888,805

(22) Filed: Aug. 16, 2022

(65) Prior Publication Data

US 2024/0058653 A1 Feb. 22, 2024

(51) Int. Cl.
*A42B 1/12* (2006.01)
*A63B 33/00* (2006.01)

(52) U.S. Cl.
CPC ..... *A63B 33/00* (2013.01); *A42B 1/12* (2013.01)

(58) Field of Classification Search
CPC ..... A42B 1/041; A42B 1/124; A42B 1/127; A63B 33/00
See application file for complete search history.

(56) References Cited

U.S. PATENT DOCUMENTS 5,544,367 A * 8/1996 March, II ..... A42B 3/324 2/410
8,087,101 B2 * 1/2012 Ferguson ..... A41D 31/285 2/455
8,966,671 B2 * 3/2015 Rumbaugh ..... A42B 3/065 2/412
10,842,216 B2 * 11/2020 Ganly ..... A42B 3/00
11,172,721 B2 * 11/2021 Cecchi ..... A42B 3/20
2004/0261153 A1 * 12/2004 Johnson ..... A42B 1/12 2/68
2008/0141431 A1 * 6/2008 Rance ..... A41D 7/00 2/243.1
2012/0317705 A1 * 12/2012 Lindsay ..... A42B 3/062 2/413
2016/0317871 A1 * 11/2016 Burns ..... A42B 1/08
2017/0065018 A1 * 3/2017 Lindsay ..... A42B 3/067
2019/0232114 A1 * 8/2019 Burns ..... A42B 1/08
2020/0001164 A1 * 1/2020 Jensen ..... A41D 20/00
2022/0007765 A1 * 1/2022 Nyström ..... A43B 7/32
2022/0225720 A1 * 7/2022 Frieder, Jr. ..... A42B 3/128
2022/0258011 A1 * 8/2022 Yeomans ..... A42C 1/00

* cited by examiner

*Primary Examiner* — Jillian K Pierorazio
(74) *Attorney, Agent, or Firm* — Caldwell Intellectual Property Law

(57) ABSTRACT

A swim cap with improvements to the design of the exterior surfaces of the cap that result in a decrease in viscous drag while swimming. A swim cap that incorporates scale tiles arranged in an array format on the exterior surface of the swim cap. A swim cap with scale tiles arranged in an array configuration that follow a uniquely defined linear flow pattern. A swim cap with scale tiles arranged in an array configuration to a uniquely defined linear flow pattern that can be formed by molding. A swim cap with scale tiles arranged in an array configuration to a uniquely defined linear flow pattern that conforms to the geometry of the specific human head it is applied to without altering the head form shape.

4 Claims, 9 Drawing Sheets

FIGURE 3A
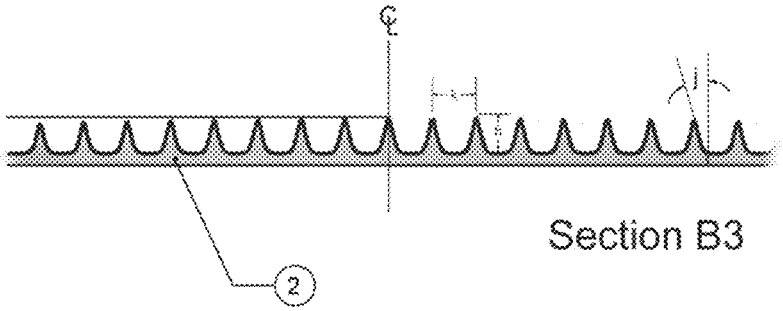
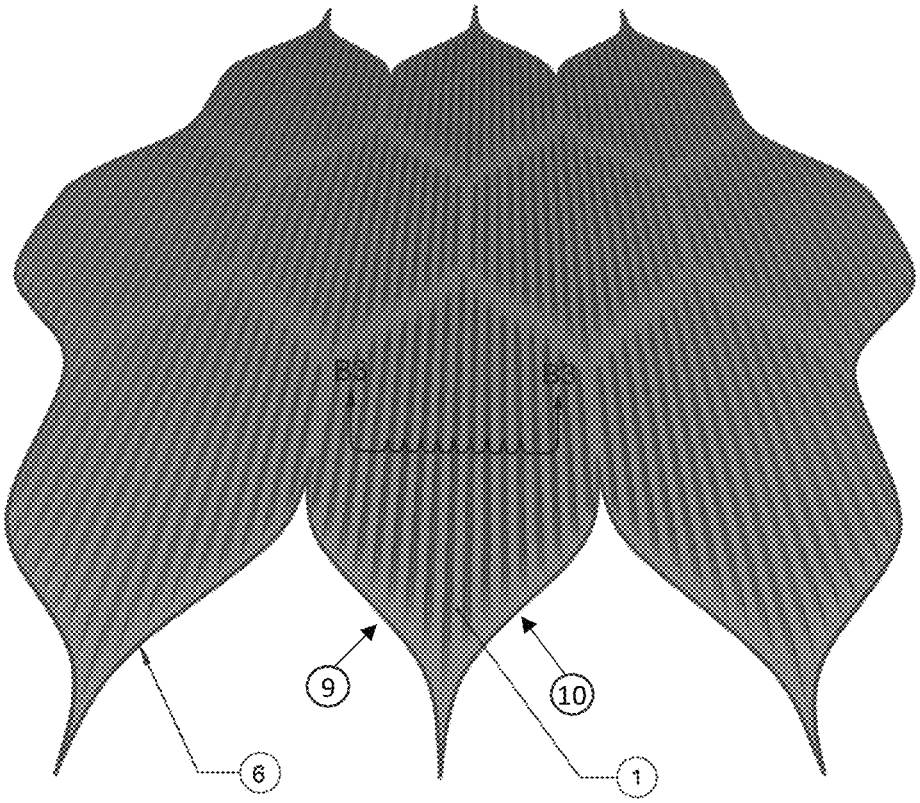
FIGURE 3B

FIGURE 4A
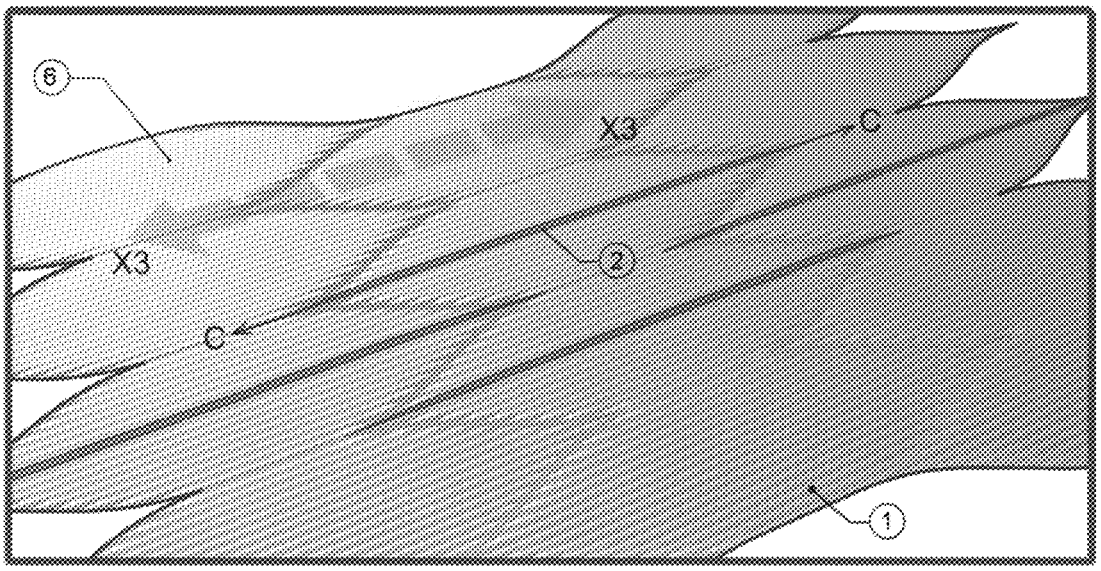
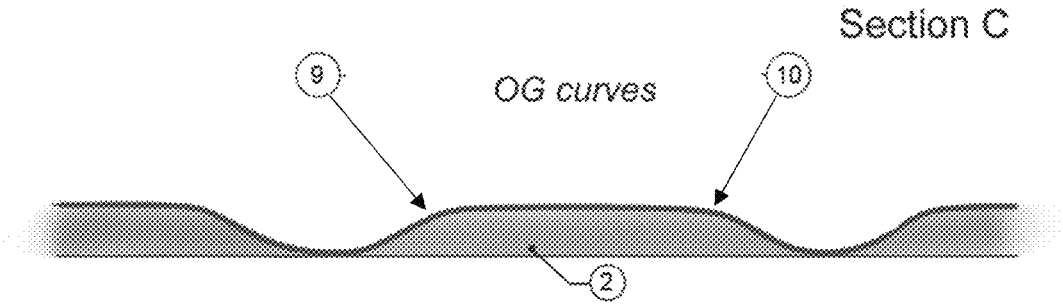
FIGURE 4B

DYNAMIC VISCOUS FLOW EFFICIENT SWIM CAP

RELATED APPLICATION

This application claims priority to U.S. provisional patent application No. 63/233,447 entitled "Aero/Hydrodynamic Efficient Swim Cap" filed Aug. 16, 2021, the contents of which provisional application are incorporated herein by reference in their entirety.

BACKGROUND

Swim caps worn on the head while swimming in water incorporate many useful functions. Swim caps form a barrier between the hair on the head and the water, keeping the hair dry. Swim caps are also used in competitive swimming (ie racing) to keep the hair close to the head—forming a compact volume around the head that mimics the shape of the swimmers head. It is of value to competitive swimmers to have the most dynamically viscous flow efficient swim cap as possible, as this can contribute to a reduction in time spent swimming over a set distance. Conventional swim caps typically include as part of their design a smooth outer exterior surface—free of any surface detailing. Therefore it would be of value to the swimmer to have a swim cap that has an exterior surface solution that is unique and novel which reduces dynamic viscous flow drag and additionally does not change the basic shape of the swim cap, or of the head when worn by the swimmer—allowing the swimmer to be more efficient while swimming.

BRIEF DESCRIPTION OF THE DRAWINGS

FIGS. 3A and 3B are perspective views of a scale tile array which details the transverse section geometry of the individual scale tiles, showing critical dimensional characteristics.

FIGS. 4A and 4B are perspective views of a scale tile array, which details the longitudinal section geometry of the individual scale tiles.

DETAILED DESCRIPTION

Disclosed herein is a swim cap of unique and novel design which incorporates functional surface features onto the external base surface area of the swim cap that facilitate a reduction in dynamic viscous drag, allowing the swimmer to swim with greater efficiency when compared to a swimmer using a swim cap of conventional design. A currently preferred embodiment of the invention will now be described in detail, with reference to the figures, to describe and illustrate various aspects and advantages of the present invention.

Figure 1:
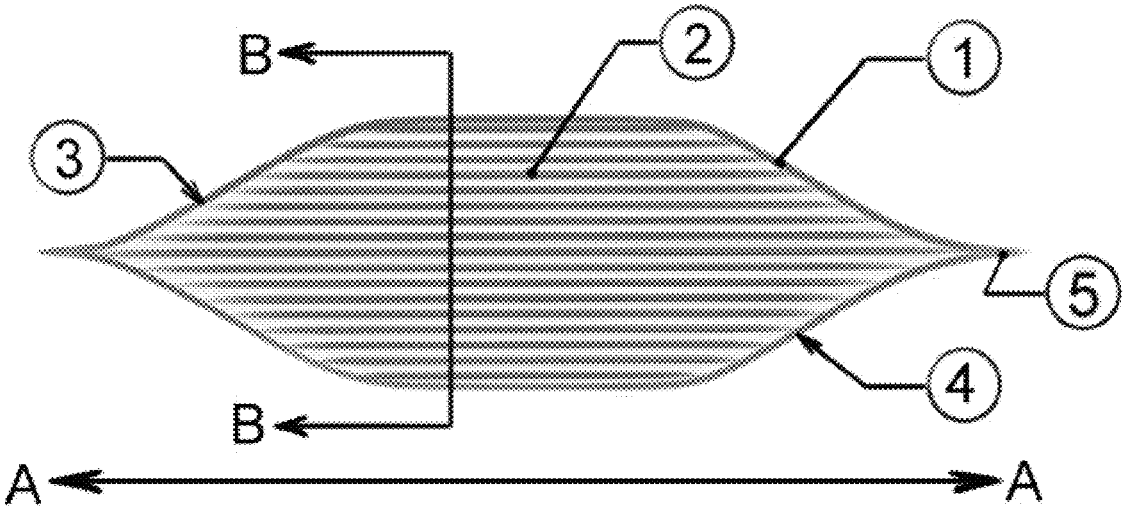
FIG. 1 is a top view of an individual scale tile.

FIG. 1 shows one embodiment of the surface of an individual scale tile 1 in top view. The scale tile is composed of individual ridges 2 commonly referred to as 'riblets'. The riblets are oriented on the scale tile along axis AA. The riblets gradually rise up to a constant height on the leading edge side 3 of the scale tile and gradually diminish at the same rate to flat on the trailing edge 4 of the scale tile, thus forming a symmetrical shape along axis AA. The scale tile is also symmetrical along axis AA through section BB. The individual scale tile is also unique in perimeter shape boundary 5, which allows for the arrangement of multiple scale tiles in a unique array format, which will be described in further additional drawings contained in the disclosure.

Figure 2:
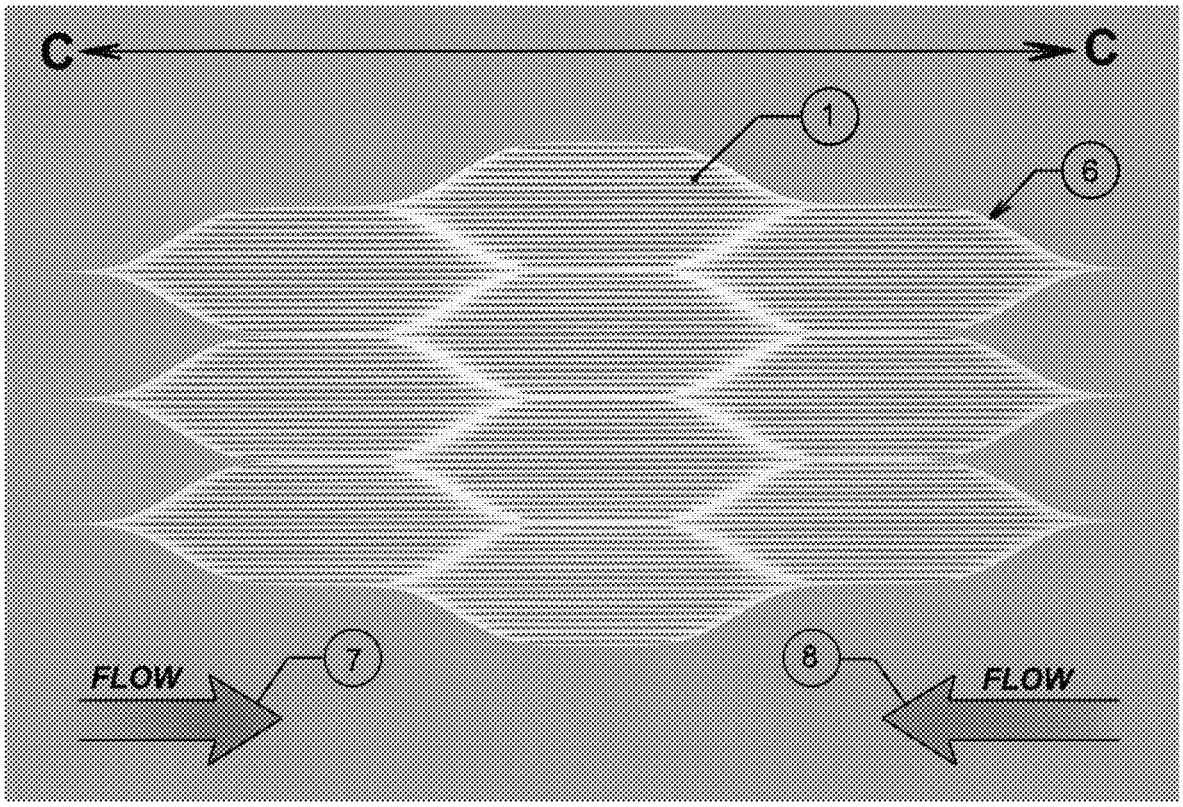
FIG. 2 is a top view of a scale tile array, constructed of a finite amount of individual scale tiles arranged in a specific geometric pattern.

FIG. 2 shows one embodiment of a scale tile array 6 composed of a finite number of individual scale 1 tiles in top view. The unique perimeter geometry of the individual scale tiles 1 allow for an optimum organizational arrangement of the individual scale tiles 1 which make up the uniquely resulting scale tile array 6. The orientation of the scale tiles that make up the scale tile array 6 allow fluid flow 7, 8 (such as air, water) in two directions along axis CC—thus permitting bi-directional fluid flow.

FIG. 3B shows one embodiment of a scale tile array 6 in perspective view.

FIG. 3A shows a cross section view B3 of the riblet surfaces 2 that make up a single individual scale tile 1. Referring to the cross section view B3, the riblet 2 max heights h are shown with spacing k, and rise approximately 0.15 mm above the base surface, with a diminishing riblet height h towards the ends of the scale tile from the center line. The riblets 2 also form a surface that can be inscribed in a triangular-like 'hat' section that forms angles "j" of approximately 15 degrees from the vertical on each side of the riblet. Spacing k of the riblets 2 in cross section is approximately 1.2 times the distance of the height h of the riblets 2.

FIG. 4A shows one embodiment of a scale tile array 6 in an additional perspective view. In FIG. 4B, Individual riblets 2 are shown in Section C, where 'OG curves' 9, 10 are formed between the end of one riblet and the start of another. Bidirectional viscous flow is denoted by arrow X3. This unique and novel transition between the riblets creates a resultant unique surface geometry with the riblets 2, which combine to form an individual scale tile 1, which then in turn combine to form a scale tile array 7.

Figure 5:
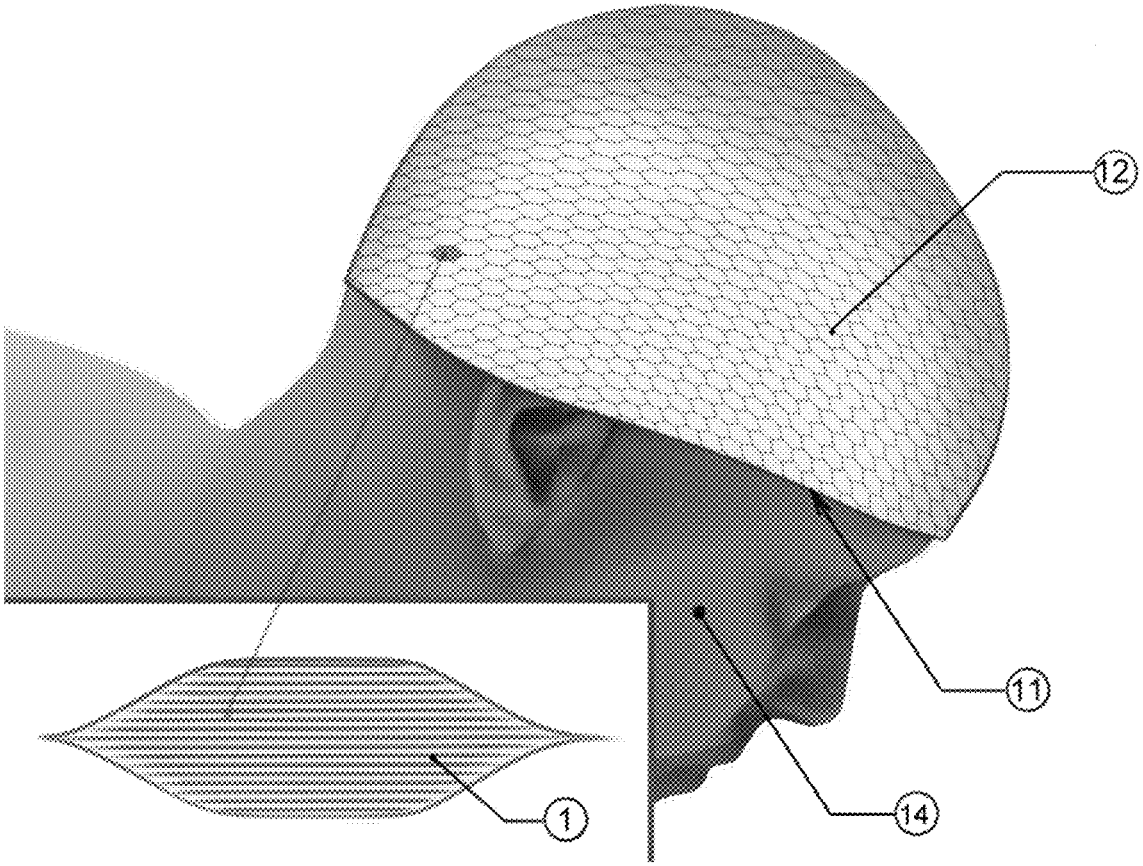
FIG. 5 is a side view of a swim cap worn affixed to the head of a swimmer, with supporting detailed views showing a specific scale geometry of the individual scale tiles that make up the scale tile array which covers the exterior base surface of the swim cap.

FIG. 5 is a side view of a swim cap 11 being worn by a swimmer 14. A scale array outline pattern 12 is shown which describes the graphic orientation of the scale array pattern on the swim cap 11. Also shown is the individual scale tile 1 in detail that makes up the scale tiles in the outline pattern 12.

Figure 6:
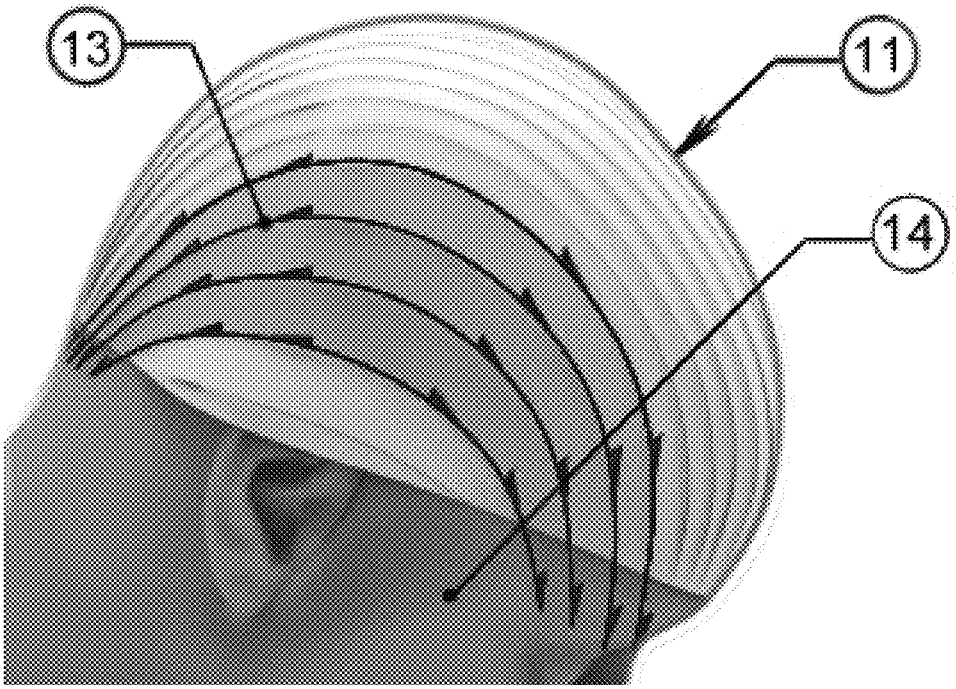
FIG. 6 is a side view of a swim cap worn by a swimmer which shows the dynamic flow lines representing viscous flow across the swim cap.

FIG. 6 is a side view of a swim cap 11 being worn by a swimmer 14. The swim cap is shown with flow lines 13 which describe the pattern orientation of the scale tile array.

Figure 7:
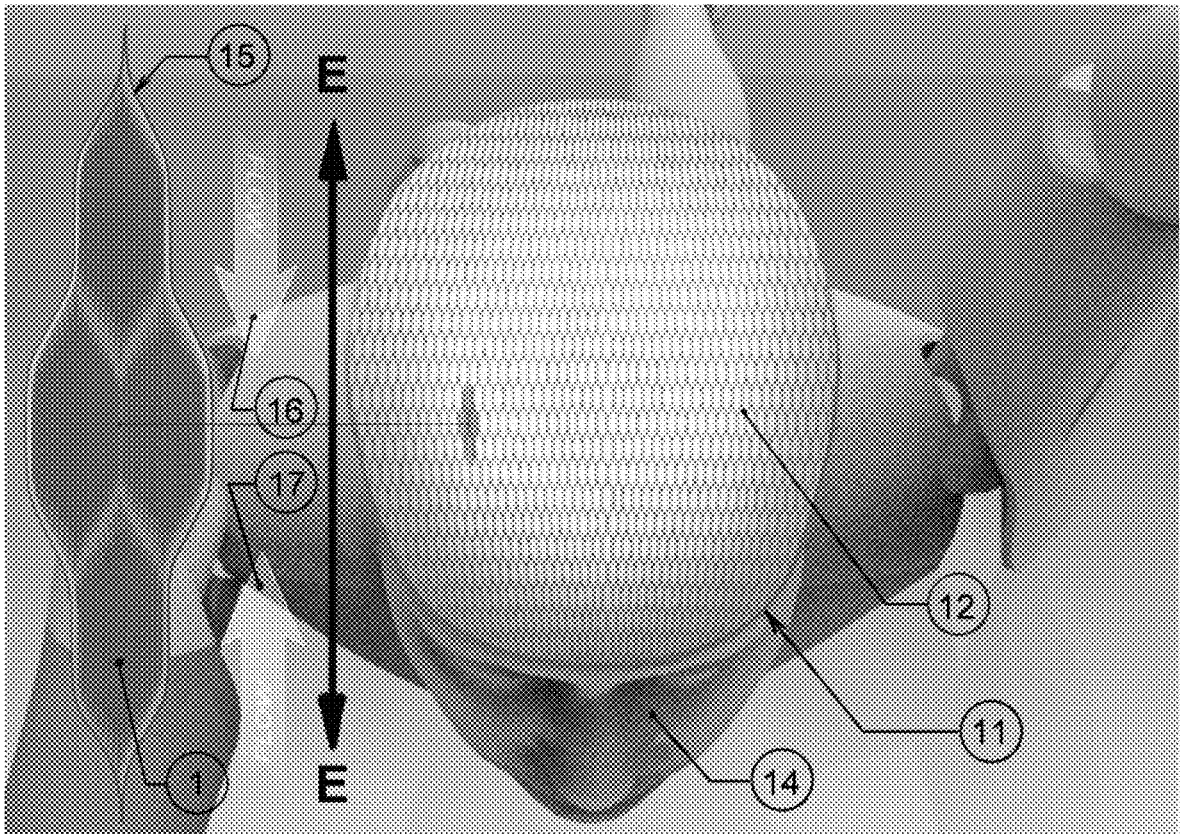
FIG. 7 is a front view of a swim cap worn affixed to the head of a swimmer, with supporting views showing a specific scale tile array geometry which covers the exterior base surface of the swim cap.

FIG. 7 is a front view of a swim cap 11 being worn by a swimmer 14. A scale array outline pattern 12 is shown which describes the graphic orientation of the scale array pattern on the swim cap 11. A scale array detail 15 is shown that is composed of a finite number of individual scale tiles 1. Fluid flow direction 16, 17 is shown along axis EE. Fluid flow (water, air) can travel along axis EE in two directions, indicating bidirectional flow. Having a scale array pattern that facilitates bidirectional flow is beneficial to the swimmer because of the head/body orientation in the water during various swimming strokes—examples being the freestyle, or crawl, and the backstroke. Bidirectional flow capability allows swimming drag efficiency gains for many swimming strokes.

Figure 8:
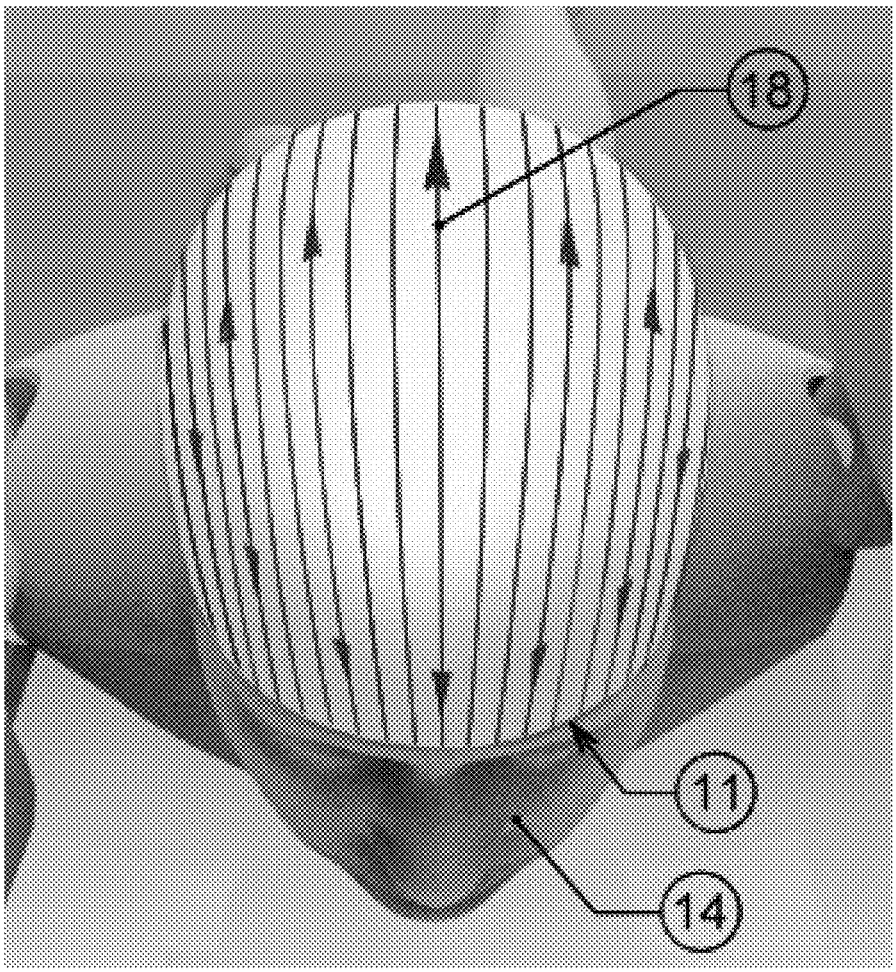
FIG. 8 is a front view of a swim cap worn by a swimmer which shows the dynamic flow lines representing viscous flow across the swim cap.

FIG. 8 is a front view of a swim cap 11 being worn by a swimmer 14. The swim cap is shown with flow lines 18 which describe the pattern orientation of the scale tile array.

Figure 9:
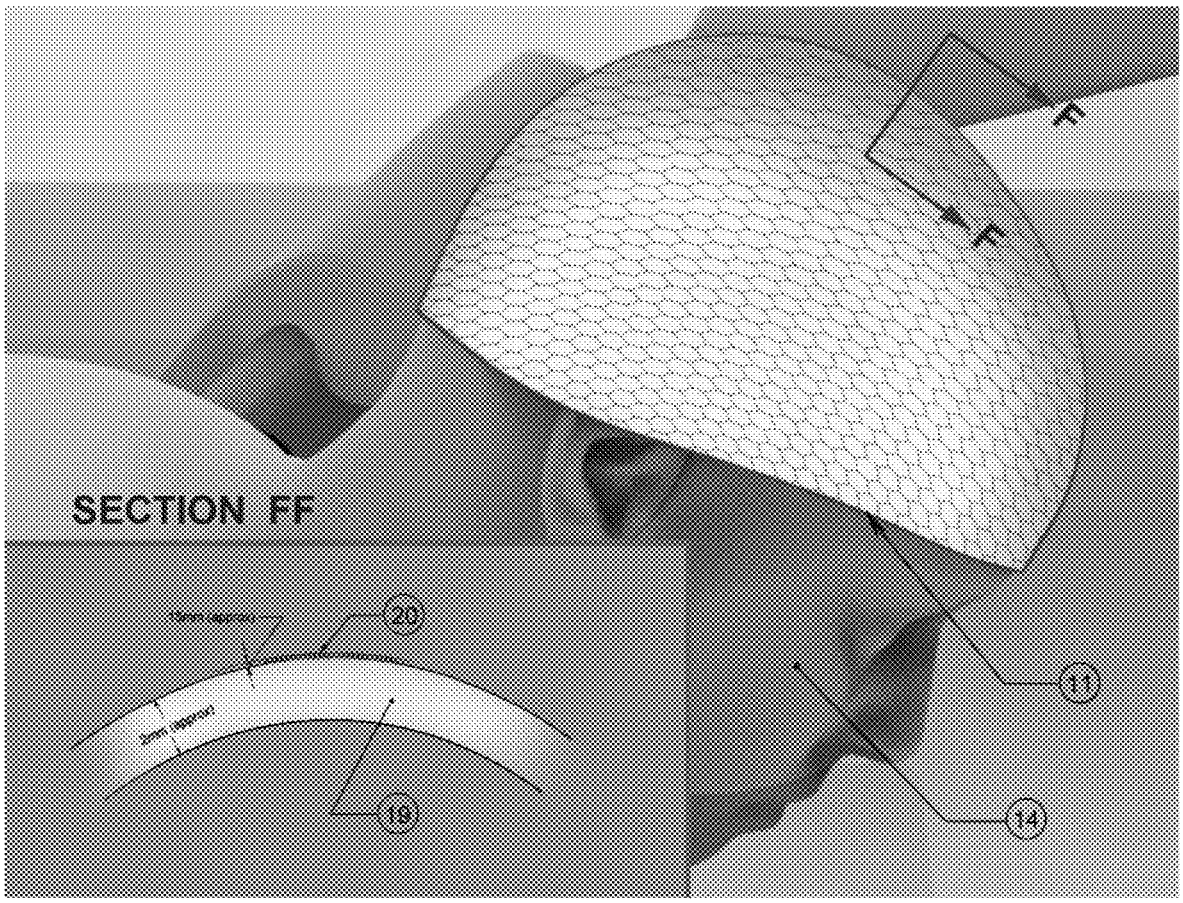
FIG. 9 is a side view of a swim cap worn by a swimmer and also a detailed image that describes the section (FF) of a swim cap. Section FF defines the swim cap thickness and the contribution in overall thickness of the functional micro surfaced geometry on the exterior of the swim cap.

FIG. 9 is a side view of a swim cap 11 being worn by a swimmer 14. Included in FIG. 9 is a detail section drawing FF of said swim cap. Section FF shows the thickness 19 of the swim cap at an approx . . . dimension of 2 mm. Also shown is a section of the scale tile array surface thickness 20 that would reside on the exterior base surface of the swim cap—at approximately 0.15 mm height. Section FF shows the contribution of overall thickness of the swim cap by the swim cap thickness 19 plus the added exterior functional scale tile array surface thickness 20 being an approximate total thickness of 2.15 mm approx.

The invention claimed is:

1. A swim cap that increases the dynamic efficiency of a swimmer by means of a reduction in dynamic viscous drag when worn by a swimmer, said swim cap comprising:

an elastomeric shell that is open along the lower periphery of the cap and can be expanded elastically to fit atop a head of a swimmer, covering a portion of the head of the swimmer;

exterior outwardly facing surfaces which incorporate geometric shapes in an arrangement that protrude outwards from the base exterior surfaces of the swim cap;

exterior outwardly facing surfaces that are not smooth;

exterior protruding outwardly facing geometric shapes composed of individual scale tiles, wherein the individual scale tiles comprise riblets, wherein the riblets rise to a constant height on a leading edge of the scale tile, wherein the riblets diminish to flat on a trailing edge of the scale tile, wherein the scale tiles are arranged in an array format with each scale tile array element having a perimeter geometry;

exterior protruding outwardly facing geometric shapes composed of unique and novel the individual scale tiles wherein the perimeter geometry defining the individual scale tile elements have symmetry about at least one axis;

exterior protruding outwardly facing geometric shapes composed of the individual scale tile elements that protrude from the exterior surfaces of the swim cap which cover a portion of the swim cap base exterior outwardly facing surfaces, or portions thereof; and exterior protruding outwardly facing geometric shapes composed of the individual scale tile elements that make up the scale tile array and protrude from the base exterior surface of the swim cap and follow a defined linear flow pattern when worn by the swimmer.

2. The swim cap of claim 1, wherein the geometric shapes which protrude outwardly from the base exterior surfaces of the swim cap do not exceed 1 millimeter in outward protrusion.

3. The swim cap of claim 1, wherein the elastomeric shell of the swim cap is configured to be expanded elastically to fit the head of the swimmer, covering a portion of the head without altering a basic head form shape of the swimmer, adding an incremental thickness to the exterior volume of the head of the swimmer.

4. The swim cap of claim 1, wherein said swim cap is formed through the molding of a material with elastic properties.

* * * * *